United States Patent [19]

Eisenberg et al.

[11] Patent Number: 4,718,604

[45] Date of Patent: Jan. 12, 1988

[54] CLAMP AND FASTENING ARRANGEMENT FOR RAILS

[75] Inventors: Helmut Eisenberg, Werdohl; Henning von Heimburg, Lüdenscheid; Friedhelm Weber, Neuenrade; Achim Beste; Dirk Vorderbrück, both of Werdohl, all of Fed. Rep. of Germany

[73] Assignee: Vossloh-Werke GmbH, Werdohl, Fed. Rep. of Germany

[21] Appl. No.: 837,594

[22] Filed: Mar. 7, 1986

[30] Foreign Application Priority Data

Mar. 15, 1985 [DE] Fed. Rep. of Germany ..... 3509472
Mar. 15, 1985 [DE] Fed. Rep. of Germany ..... 3509473

[51] Int. Cl.[4] ..... E01B 9/48
[52] U.S. Cl. ..... 238/349; 238/338
[58] Field of Search ..... 238/264, 338, 343, 349, 238/310, 350, 351

[56] References Cited

U.S. PATENT DOCUMENTS

| | | | |
|---|---|---|---|
| 3,004,716 | 10/1961 | Pande-Rolfsen | 238/349 |
| 4,306,677 | 12/1981 | Fischer | 238/349 |
| 4,350,291 | 9/1982 | Dobson | 238/349 |
| 4,442,973 | 4/1984 | Fee | 238/338 |

FOREIGN PATENT DOCUMENTS

| | | | |
|---|---|---|---|
| 70800 | 1/1976 | Australia | 238/349 |
| 95210 | 11/1983 | European Pat. Off. | 238/343 |
| 2461158 | 7/1975 | Fed. Rep. of Germany | 238/349 |
| 2048345 | 12/1980 | United Kingdom | 238/349 |

*Primary Examiner*—David A. Scherbel
*Assistant Examiner*—Carol L. Olson
*Attorney, Agent, or Firm*—James J. Ralabate

[57] ABSTRACT

The invention describes a clamp for rails that is produced from resilient steel bar with multiple bends. The first section (11) of the rail clamp (9, 10) is essentially horizontally arranged, while the last section (14) rests on the rail flange (5). The second section (12) curves upwards in the vertical plane that passes through the first section (11). The remaining sections of the clamp lie all on the side of the first section that faces the rail. The fastening arrangement comprises an anchoring part (20) where the supporting surface (23) for a supporting section of the clamp (9, 10) is located essentially vertically above the locating hole (24) of the clamp (9, 10). That produces a relatively short clamp requiring a minimum of material.

12 Claims, 23 Drawing Figures

CLAMP AND FASTENING ARRANGEMENT FOR RAILS

Figure 1:
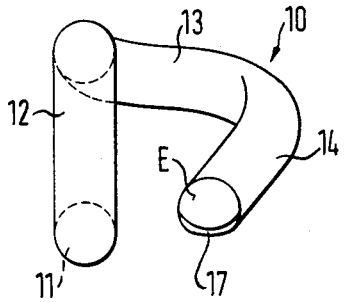

The invention relates to a clamp, an anchoring element and a fastening arrangement for rails.

From AT-PS No. 298 542 is known a fastening arrangement for rails with a clamp made from resilient steel bar material and bent in five sections. The first section of the clamp has its end inserted in a hole an anchoring part of the fastening arrangement and winds in relatively wide curves describing wide angles in the horizontal, about the locating part of the anchoring part. The end of the bar lies parallel to the beginning of the bar. The third section of the clamp rests against an essentially horizontal supporting surface of the locating part that is arranged on the side of the hole pointing away from the rail, whilst the fifth and last section, which features a flat portion, rests on the upper side of the rail flange. However, the clamp of this known arrangement has the disadvantage that it can also be driven wrongly into the locating part, that is to say in such a manner that the undersides of the fifth and third sections are reversed. That can significantly reduce the holdingdown force of the clamp. In addition, the known clamp is relatively long so that its material requirements are considerable.

From DE-OS No. 24 61 185 is known a clamp for a fastening arrangement for rails where the clamp is produced from a longer bar than is the case with the aforementioned arrangement. That means very high material requirements for the clamp.

Finally, we know from DE-PS No. 26 49 527 a fastening arrangement with a clamp where the length of the individual sections of the clamp was reduced in order to reduce the amount of material required. Viewed from above, this clamp looks like the letter "e" or rather its mirror image. However, since the locating part of the anchoring part of this known arrangement is equal-sided, it is not possible to eliminate completely the risk of the clamp being driven in wrongly. Besides, the material requirements for this clamp must still be rated as relatively high.

The AT-PS No. 298 542, DE-OS No. 24 61 158 and DE-PS No. 26 49 527 relate to an anchoring element for relevant fastening arrangements. It features an upper locating part with a locating hole for the clamp that is parallel to the longitudinal direction of the rail and with an essentially horizontal supporting surface located on a supporting part arranged on the side that points away from the rail. An anchoring part extending from the underside of the locating part vertically downwards has a wavy surface in order to prevent the easy withdrawal of theanchoring element from the concrete sleeper. However, these known anchoring elements facilitate only the use of rail clamps of arelatively complex, material-intensive design, that is to say clamps with several curved sections. In addition, the pressure bearing on the horizontal supporting surface is relatively high. One tries, therefore, to absorb the supporting moment acting on the anchoring element through the supporting surface by means of a specially strong design of the supporting part that rests on the upper surface of the sleeper. However, this transverse moment cannot be fully compensated in its effect, so that there occurs a loosening of the anchor in the concrete especially as a result of the slipping of the rail when a train passes. At the same time the additional support of the clamp in the locating hole has the effect of a torque acting on the locating part essentially vertically to the direction of the axis, which also becomes effective in the vertical plane passing through the retaining section of the clamp in accordance with the inclination of the second section of the clamp. Also, when driving home the clamp, blows are delivered to this second, inclined section so that considerable additional axial forces are brought to bear that can cause the loosening of the anchoring system in axial direction. In addition, a torque acting about the vertical axis of the anchoring part is released during the driving-in operation due to the inclined second section of the supporting surface. Apart from the relatively broad underside of the supporting part and a, in transverse direction, wide anchoring part with a wavy surface, these known anchoring elements offer no precautions whatever to counter any loosening or even withdrawal of the anchor from the concrete sleeper as a result of the forces outlined above.

Also known from EP-A No. 0 050 048 is an anchoring element whose upper locating part is essentially identical to the locating part of the afore-mentioned anchoring element. For that reason essentially the same forces or torques occur as with the afore-mentioned anchoring elements. However, to counter any twisting about the vertical axis, this anchoring element has walls arranged below the locating part that point in the longitudinal direction of the rail. Furthermore, to prevent the vertical withdrawl of the anchoring element, triangular projections, whose upper sides are essentially horizontally aligned, are arranged at the bottom end of the anchoring part. In this way these projections act as hooks and increase the withdrawl resistance of the anchoring part accordingly. However, this known anchoring element does not include special provisions to reduce the forces acting on the locating part. Nor have measures been taken for the better absorption of axial shearing forces. Lastly, this known anchoring element facilitates only the use of relatively long clamps which fails to allow for desirable savings in material requirements.

The object of the invention is to produce a clamp, an anchoring element and a fastening arrangement for rails that save material, have good holding-down properties and are simple and reliable in their construction, function/operation and assembly.

The invention solves this problem with a clamp of the type referred to at the beginning, in that the second section is bent upward in a vertical plane passing through the first section and all subsequent sections of the clamp lie on the side of the first section that faces the rail.

In the case of the clamp in accordance with the invention, no section lies even partly on the side of the first clamp section (retaining section) that points away from the rail, so that it was possible with this clamp design to produce the shortest clamp of its kind. This facilitates significant savings in material which in turn increases the economy of the product.

A first embodiment of the invention shows a clamp with four successive sections that are designed in such a manner, i.e. that show such a spatial arrangement that, in top view, the clamp looks like the Greek letter "$\eta$" and in side view like an "e"-shaped loop, or rather their mirror images. The second section forms an arch that covers an angle of not less than 180° and whose end shows essentially the same horizontal direction as the start of the first section. The third or last-but-one section is again curved with a downward inclination. The end of this section, wherein this arched section covers an angle of at least 180°. The fourth and last section of the clamp is essentially straight, but with a very wide curve that is open towards the top. In addition, this last section describes acute angles in relation to the horizontal and vertical planes passing through the first section. This specially curved design of the clamp according to the invention ensures that despite a minimum of material expenditure, the torsion arm of the clamp has a high tension force (11 kgf approx.) coupled with an adequate spring travel (100 mm approx.). The clamp can consequently be used with at least the same good effect as the rail clamps used hitherto.

Another design variation according to the invention provides for a relatively short, flat portion on the last section of the clamp, wherein the flat portion is crowned in a vertical plane perpendicular and parallel to the longitudinal direction of the rail. This results in an optimum locating surface that is independent of the rail flange.

Of particular advantage is the fact that the two ends of the clamp according to the invention protrude beyond the curved sections—when viewed in the horizontal direction. Therefore, the clamp is a kind of torsion spring and has, consequently, the positive properties of the latter. With a minimum length it has a high tension force and permits a relatively big spring travel. In addition, the relatively long starting and end sections permit good mounting of the clamp and, thus, a good transmission of energy or load.

In another design variation the clamp according to the invention can consist of five sections. The fifth, additional section is arranged between the second and third sections and runs essentially in the same vertical plane as the first and second sections of the clamp. In so doing it forms an arch whose first part slopes towards the first section whilst the second part is designed to rise in relation to same before being followed by the last-but-one section. Viewed in longitudinal direction, the beginning and the end of this clamp lie within the curved sections of the clamp. With this design of the clamp it is possible to achieve a different support situation than with the first embodiment. This second design variation of the clamp offers also several advantages as outlined above in connection with the first design variant. For example, significant savings in material are made possible by the fact that all sections lie on the side of the rail flange. In addition, when viewed across the direction of the rail, this clamp takes up considerably less space than the conventional clamps that are of a much more complex design.

In addition, the afore-mentioned problem is solved with a fastening arrangement for rails where the supporting surface of the locating part is arranged essentially vertically above the hole and where the clamp is a clamp in accordance with claims 1 to 9 that rests against the supporting surface with a section that lies in the vertical plane above the first section.

The clamp described above rests, therefore, against a supporting surface with the clamp section that lies in the vertical plane above the first section. This supporting surface is arranged essentially vertically above the hole that takes the first section of the clamp. According to the invention the clamp rests, therefore, against a supporting surface that is arranged essentially vertically above the hole on the upper side of the locating part of the anchoring part. This match design of clamp and anchoring part facilitates the material-saving design of the arrangement, especially the clamp. By arranging the supporting surface directly above the hole and not on the side of the hole that points away from the rail, as is the case with the known clamps, it was possible to design the clamp with the optimum shortness according to the invention.

The vertical arrangement of retaining section (1st section) and supporting arch (2nd section) makes the fitting of the clamp much easier because the fitter knows that the second section must always point upward when inserting the clamp. With the second section in upright position, it is as easy to drive in the clamp mechanically as it is for the fitter to knock it in by hand (using a hammer). In addition, it is possible due to the simple design of the clamp to recognize immediately the correct direction of insertion since, with the second section pointing vertically upward, the subsequent sections will always point in the direction of the rail. This ensures that the clamp is always fitted in the correct direction of insertion. In the event that the fitter should nevertheless insert the retaining section of the clamp into the wrong end of the hole in the locating part, he will immediately realize his mistake because the clamp is very loose since it has no lateral support whatever.

According to the invention, the supporting surface can be arranged in a variety of ways on the upper side of the locating part. This flat, essentially horizontal upper surface of the locating part can serve as a supporting surface, for example. However, this means of support is only available when using a clamp of the second design variation, that is to say the clamp with five sections. In this case the third section, that is to say the section curved downward after the vertical second section, rests resiliently with its lowest point against the flat supporting surface.

Even better and more effective support is achieved with the five-section clamp by designing the upper surface of the top part with two ribs each in the longitudinal direction of the rail. These ribs form between them a groove-like channel in which the supporting arch of the clamp engages. The side walls of the ribs ensure lateral guidance and support for the clamp. There is no need to fear that imperfect alignment of the clamp during insertion could lead to a slanted installation and thus inadequate support with all its negative consequences. It can also suffice to have only a single lateral rib, namely on the side of the clamp that points away from the rail.

In another design variation the said lateral rib on the upper side of the locating part can be raised considerably in a vertical direction, thereby producing a lug-like shape. In that connection it is of particular advantage if the vertical, lateral supporting surface of the strip lies in a plane tangential to the locating bore. In that way the clamp can rest against the supporting surface with the second, up-curved section. The result isoptimum alignment of the clamp during fitting.

In the case of the four-section clamp according to the invention, designing the locating part with a vertical supporting surface at the strip-like elevation is particularly advantageous because the vertical supporting surface of the strip absorbs in full the supporting forces of the clamp. Additional support on a horizontal surface of the locating part is not necessary, therefore. It is thus possible to save a fifth section, that is to say a vertically effective supporting section.

The strip-shaped, vertical supporting part extends advantageously only over the first half of the locating part, that is to say on its insertion side. The height of the supporting part is essentially matched to the height of the clamp in assembled condition of the arrangement. The supporting part does not protrude beyond the highest point of the clamp in assembled condition of the arrangement. That means that no additional space is required for the supporting part.

A special advantage is achieved in that the locating hole on the insertion side is open towards the top over the width of this hole. The vertical supporting surface of the supporting part is thus merging into the insertion groove formed in this way. It is useful if the insertion groove measures about one third the length of the locating part. In that way the second section of the clamp, that is to say the supporting arch section, can be inserted into the locating part so that the clamp does not protrude beyond the front face of the insertion side of the locating part. That produces a particularly compact form of the fastening arrangement. In addition, the clamp can rest on the vertical supporting surface essentially with the entire supporting arch. That guarantees optimum support conditions.

To facilitate easy driving-in of the clamp, the supporting strip features a leading-in chamfer on the insertion side so that the full supporting forces need not be overcome throughout the entire driving-in operation, but preferably only on the last third of the supporting part length.

To facilitate easy insertion of the retaining section of the clamp in the retaining hole of the locating part, these two parts have hitherto been produced with a relatively big clearance between them. The start of the retaining section did not protrude from the retaining hole, but was wedged into the hole by the torsional forces, so that it would normally work itself into the hole, thereby preventing any axial displacement and possible withdrawl of the clamp from its mounting.

However, this design does not constitute an absolutely reliable solution. Whilst the invention is also allowing plenty of play between the retaining section and the retaining hole, the retaining section is of such a length that its front end protrudes from the front face of the locating part when assembled. In that way the end of the retaining section can wedge itself into the end of the hole, thereby achieving an effect similar to the effect described above. To secure the clamp reliably against withdrawal from the retaining hole, the invention provides for a recess on the vertical down-side of the retaining section of the clamp, so that the protruding end of the clamp is hook or notch-shaped. As the clamp is driven in, its tensioned condition causes the retaining section to be raised so that this notch reaches behind the corresponding front face of the locating part. This engagement of the clamp in the locating part prevents any unintentional loosening of the clamp. The arrangement according to the invention is advantageous, therefore, both in respect of the assembly, as well as regards its functionality.

Finally, it is possible to pre-assemble the clamp on the sleeper, e.g. at the sleeper manufacturer's works, when the clamp is turned 180° about the horizontal axis in relation to its assembled position, so that it lies outside the rail area.

According to a further development of the fastening arrangement in accordance with the invention, the bottom part of the anchoring part can be an essentially vertically down-pointing, basically known, anchor for mounting in concrete sleepers. However, according to the invention the bottom part can also be a bed plate with holes for fastening to wooden, concrete or steel sleepers, using bolts or similar components. On the upper side of the plate there are two opposing locating parts. The locating parts are offset so that the clamps inserted in same rest essentially centrally—in relation to the bed plate—on both sides of the rail flange. However, the two locating parts can also be arranged coaxially on the plate. That offers the advantage of a narrower plate.

Lastly, the invention relates to an appropriate anchoring element. The anchoring element according to the invention features, therefore, an upper locating part with a locating hole aligned in the longitudinal direction of the rail and a supporting surface for a clamp. On its underside there is a vertically down-pointing anchoring part the bottom end of which features triangular projections, whilst its upper end is provided with walls that are connected to the locating part.

It is characterizing that the supporting surface of the locating part is arranged essentially vertically above the locating hole. This creates a completely new situation concerning the introduction of forces and the resulting loads. In addition, it is significant that the supporting surface of the locating part is arranged essentially vertically above the locating hole, that the triangular projection at the bottom end of the anchoring part forms an essentially equal-side triangular foot piece which, in cross-section, has also essentially the shape of a narrow rectangle with the same orientation as that of the remaining anchoring part and whose base forms the bottom surface of the anchoring part, whilst its two sides continue at an acute angle into the narrow sides of the anchoring part so that the broad sides of the foot piece are aligned parallel to the longitudinal direction of the rail. This very large wing-type foot piece serves also to increase significantly the anchoring element's resistance to twisting and withdrawal. The anchoring element according to the invention features consequently only a single component for the said objectives, whereas the state of the art necessitates two different elements (triangular projections and upper axial wings). Finally, according to the invention, the vertical walls provided on the underside of the upper locating part in conjunction with the anchoring part, are arranged across the longitudinal direction of the rail, so that they are fully effective against the forces that occur when a train passes.

According to a further development of the subject matter, the walls acting against any displacement of the anchoring element in the longitudinal direction of the rail can have a simple, rectangular shape. However, they can also have theshape of an equal-sided triangle standing on its apex.

To prevent even more effectively any twisting or withdrawal of the anchoring part from the concrete sleeper, it is possible to provide, in addition to the triangular projection in the longitudinal direction of the rail, also a projection in transverse direction that is of the same design. Furthermore, the anchoring part can also be designed with additional openings and/or a wavy surface.

Another preferred anchoring element with an upper locating part for a clamp and an anchoring part for mounting in a sleeper features an anchoring part with a cross-shaped profile across its longitudinal axis with the elements of the cross each ending at the bottom end in a roughly rectangular widening whose upper limit is roughly vertical to the longitudinal axis of the anchoring part. This design of the anchoring part has proved particularly useful in conjunction with concrete sleepers because it ensures a firm hold in the sleeper without cracking of the concrete even with high extraction forces.

It is of great advantage that the locating part permits the use of a clamp that has a relatively short length and which offers, therefore, considerable savings in material. In addition, this clamp is designed so that in assembled condition the second section of the clamp curves vertically upward. This section is followed by only two further sections that curve back and on to the rail flange. The second vertical clamp section serves as a supporting section with which the clamp rests against the vertical supporting surface of the locating part of the anchoring element. The supporting surface forms part of a strip-like support on the locating part which, in its most advantageous design, measures about half the length of the locating part and is arranged on the clamp insertion side. In addition, it is of advantage when the supporting part does not exceed significantly the height of the clamp in assembled condition. Special structural advantages can be achieved when the locating part on the insertion side is open towards the top over the width of the locating hole, ideally over a length of about one third the supporting part. That forms a groove that is open at the top and with which the supporting surface merges tangentially. In this connection it is of special advantage that the second section of the clamp, in the direction of insertion, is inserted essentially fully into the area of the locating part.

For easy insertion of the clamp the supporting part features a chamfer in the direction of insertion. This leading-in chamfer can cover about two thirds of the length of the supporting part.

The special design of the locating part and the interaction of the four-section clamp with the locating part result in a favourable force situation where the forces are conducted into the substructure without any loosening of the anchoring element, which is also countered by the special design of the anchoring part.

The subject of the invention is described below in greater detail with reference to the embodiments illustrated in the attached drawing.

Figure 2:
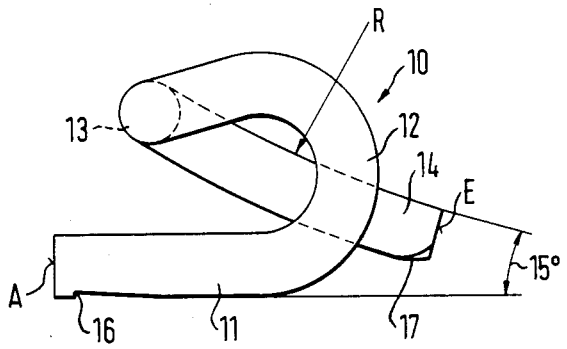
Figure 3:
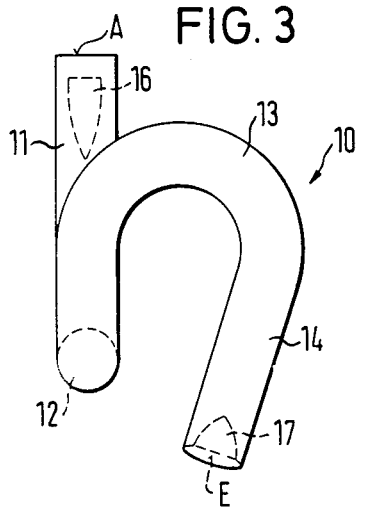
Figure 4:
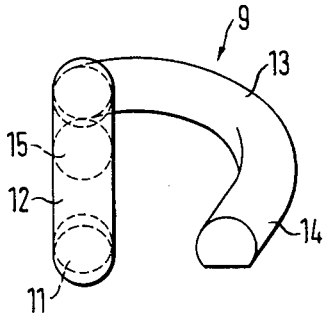
Figure 5:
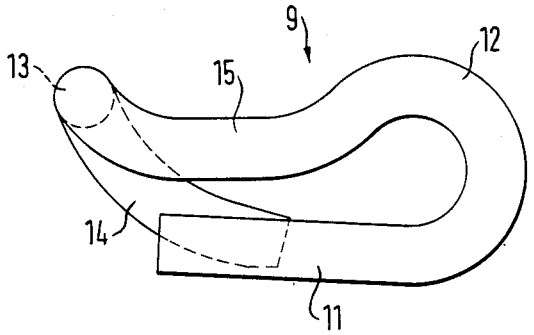
Figure 6:
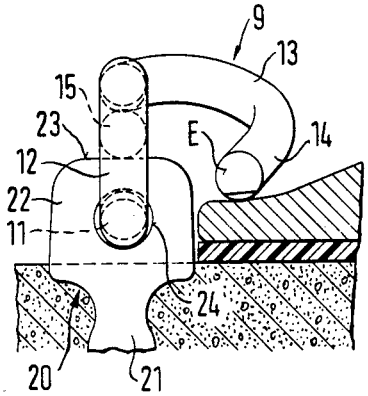
Figure 7:
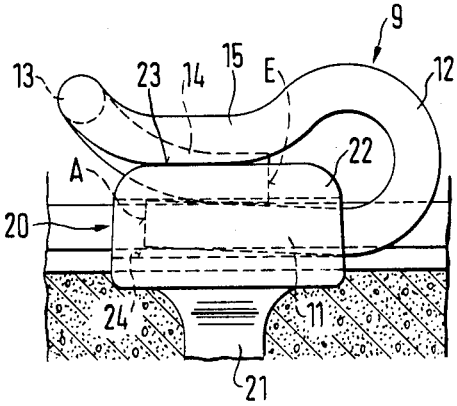
Figure 8:
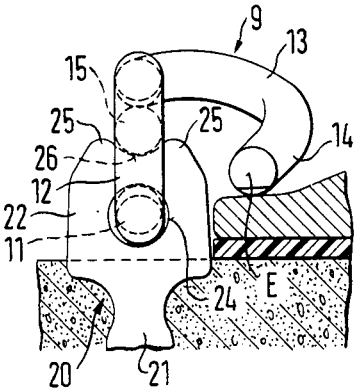
Figure 9:
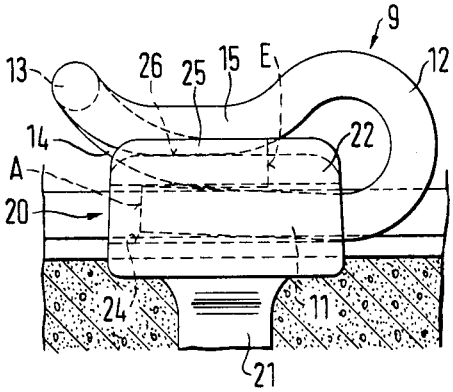
Figure 10:
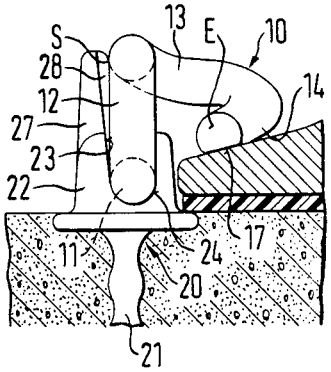
Figure 11:
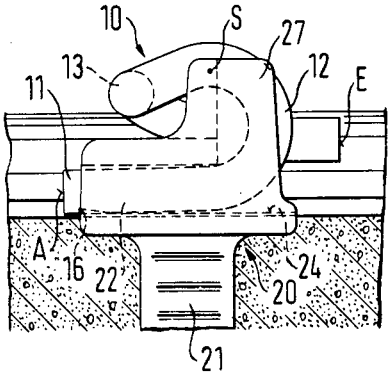
Figure 12:
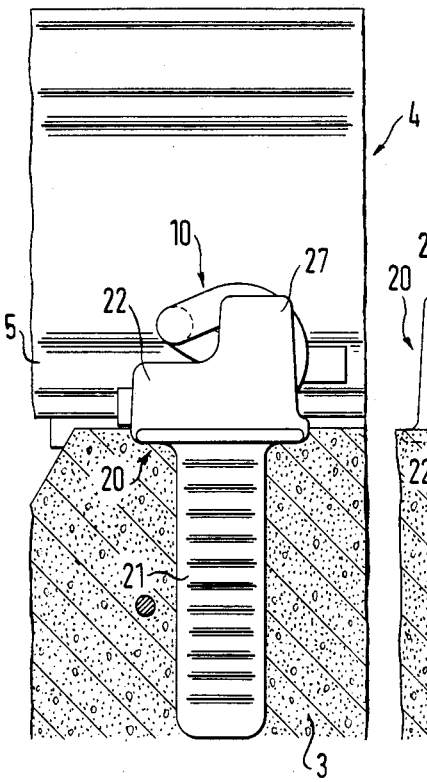
Figure 13:
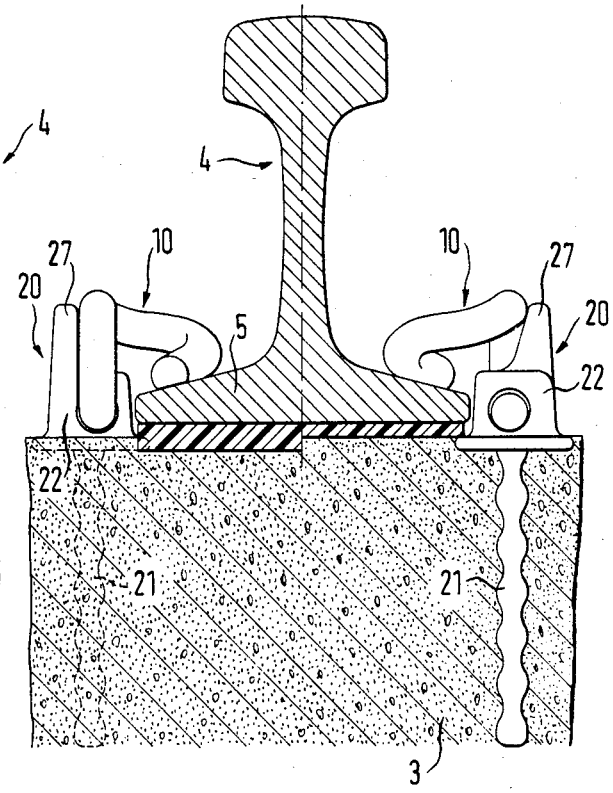
Figure 14:
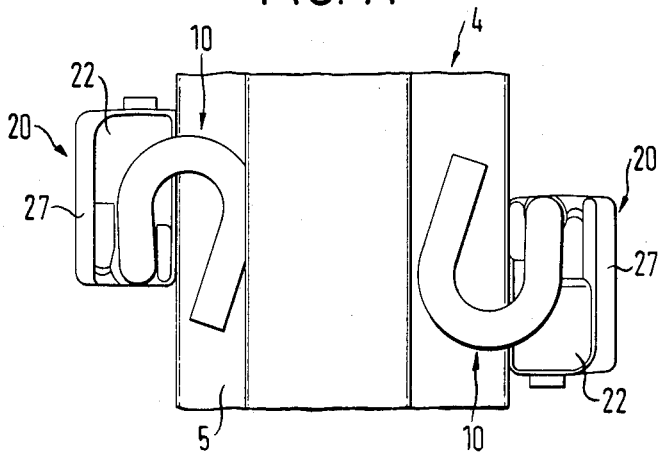
Figure 16:
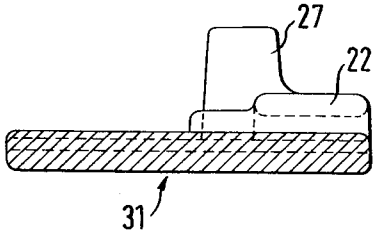
Figure 15:
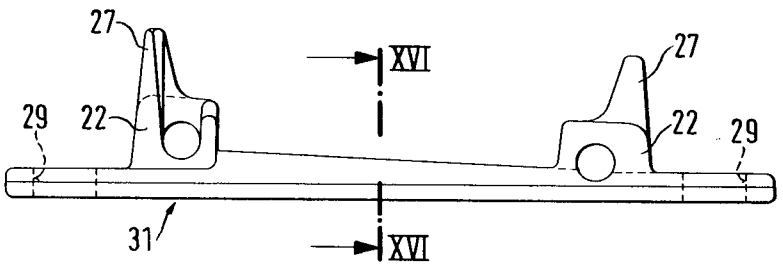
Figure 17:
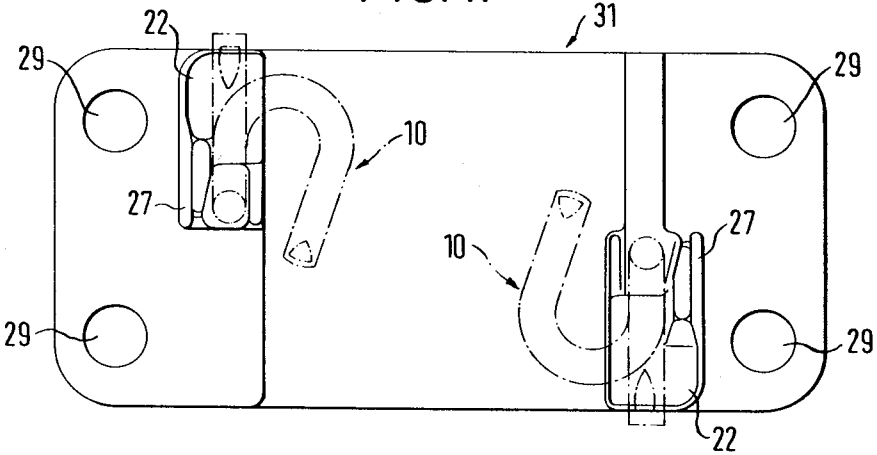
Figure 18:
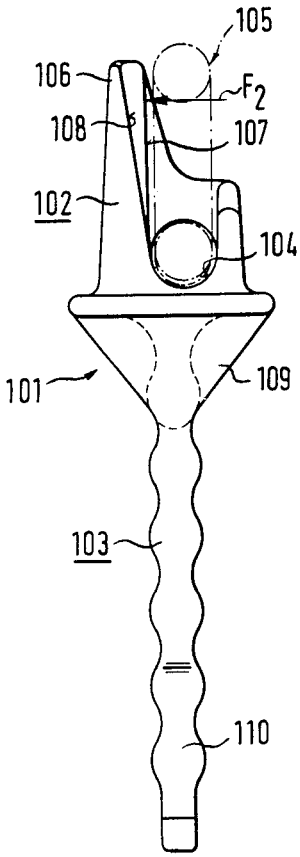
Figure 19:
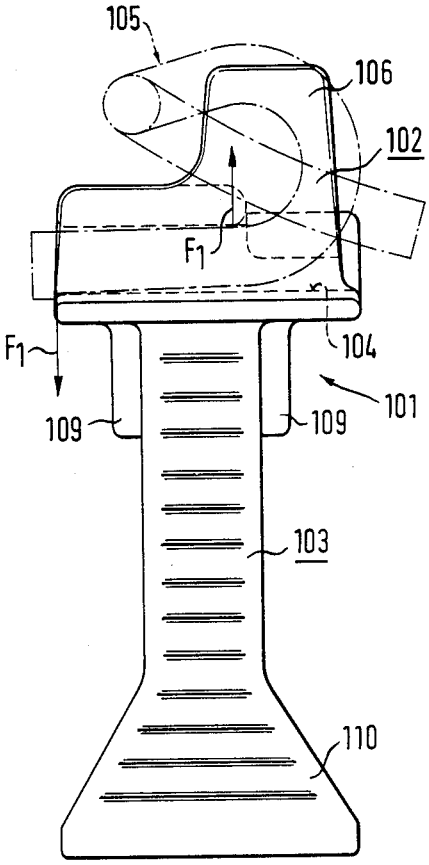
Figure 21:
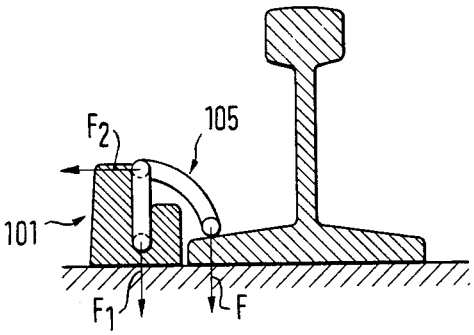
Figure 20:
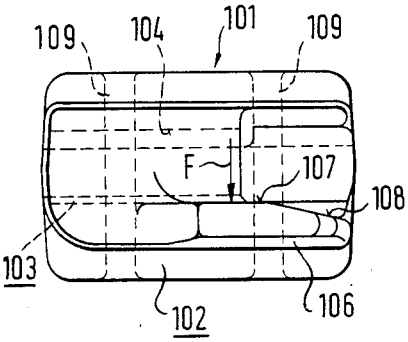
Figure 22:
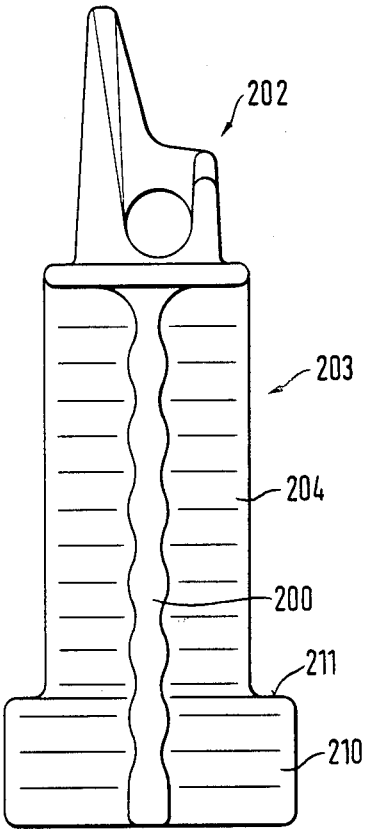
Figure 23:
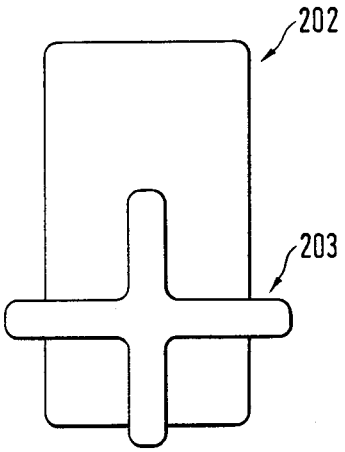

In the drawing:

FIGS. 1 to 5 show two embodiments of the rail clamp according to the invention, that is to say FIG. 1 shows a side view of the clamp in its first embodiment, FIG. 2 shows a side view of the clamp according to FIG. 1, when viewed across the longitudinal direction of the rails, FIG. 3 shows a top view of the clamp according to FIG. 1, FIG. 4 shows a side view of the second embodiment of the clamp in the longitudinal direction of the rail, FIG. 5 shows the clamp according to FIG. 4 in side view across the longitudinal direction of the rails, FIGS. 6 to 11 show three different embodiments of the fastening arrangement according to the invention, wherein only the interaction (support) of the clamp with the locating part of an anchoring part mountable in concrete sleepers is shown, that is to say FIG. 6 shows the view in the longitudinal direction of the rail of a clamp with five sections together with a locating part with a flat, horizontal supporting surface, FIG. 7 shows a view across the longitudinal direction of the rail of the arrangement according to FIG. 6, FIG. 8 shows a view in the longitudinal direction of the rail of a clamp with five sections and a locating part with supporting groove, FIG. 9 shows a view across the longitudinal direction of the rail of the arrangement according to FIG. 8, FIG. 10 shows a view in the longitudinal direction of the rail of a clamp with four sections in its interaction with a locating part with a vertical supporting surface, FIG. 11 shows a view across the longitudinal direction of the rail of the clamp and locating part according to FIG. 10, FIGS. 12 to 14 show the fastening arrangement according to the invention complete with rail, anchoring parts for concrete sleepers and clamps, that is to say FIG. 12 shows a view of the arrangement across the longitudinal direction of the rail, FIG. 13 shows a partial cross-section through the arrangement, FIG. 14 shows a top view of the arrangement, FIGS. 15 to 17 show a bed plate with two locating parts, that is to say FIG. 15 shows a view in the longitudinal direction of the rail of the bed plate, FIG. 16 shows a section through the bed plate along line XVI-XVI of FIG. 15, and FIG. 17 shows a top view of the bed plate according to FIG. 15, FIG. 18 shows a view in the longitudinal direction of the rail of an anchoring element according to the invention, FIG. 19 shows a view of an anchoring element according to FIG. 18 across the longitudinal direction of the rail, FIG. 20 shows a top view of an anchoring element according to FIG. 18, FIG. 21 shows a diagrammatic view of the forces acting through the rail clamp onto the anchoring element and the rail, FIG. 22 shows a further embodiment of an anchoring element for a clamp in a sleeper, and FIG. 23 shows a bottom view of the anchoring part of this anchoring element.

FIGS. 1 to 3 show the first embodiment of the rail clamp which, in its entirety, is given the reference number 10. The clamp consists of a bar of suitable steel with multiple bends and can be divided into four sections. The orientation of the individual sections of the clamp is described below with reference to the assembly position of the clamp. Accordingly, the first section 11 of the clamp 10 runs essentially horizontally and features a front face A that is vertical to the axis of the bar. The first section 11 is followed by a second section 12 which curves upward and then back in an essentially vertical plane passing through the first section 11, so that the end of the second section 12 points essentially in the same direction as the beginning A of the clamp 10. The second section 12 is followed by a curved third section 13 which slopes down at an angle to the vertical as well as the horizontal planes. Finally, there follows a fourth and last section 14 which, in relation to the third section 13, inclines downward and inward, and in relation to the first section 11 runs in the opposite direction, showing a slight curvature R that is open towards the top.

Like the front face A, the end face E of the section 14 is vertical to the axis of the bar, but with an inclination of about 15° in relation to the horizontal. The end of the first section 11 facing the front end A features a stepped recess that forms a notch 16 on the underside of this section 11. The other end E of the clamp 10 features a flat portion 17 with which the clamp 10 rests on the rail flange in a manner still to be described. Viewed in axial direction, this flat portion features a 14° chamfer in relation to the horizontal, and viewed across the longitudinal axis of the rail an inclination of 5°.

The second variant of the rail clamp illustrated in FIGS. 4 and 5, which, in its entirety, is given the reference number 9, can be divided into five sections. The additional fifth section 15 is arranged between the second section 12 and the section 13. It passes essentially in the vertical plane through the first section 11 and is designed so that its first half inclines downward whilst its second half rises upward.

The ends of the clamp 9, viewed in axial direction, do not protrude beyond the curved sections 12, 13 of the clamp 10. Against this the ends of the clamp 10 of the first embodiment are designed to protrude beyond the curved sections 12 and 13.

FIGS. 6 to 11 show the interaction and functional matching of the clamp 9 or 10 with the locating part 22 of an anchoring part 20 in accordance with the invention.

The first embodiment shown in FIGS. 6 and 7 uses the clamp 9 with five sections. The first section 11 of the clamp 9 is inserted in an horizontal hole 24 in the locating part 22 of the anchoring part 20. It will be seen that the hole 24 has a bigger diameter than the clamp 9. In tensioned condition its first section 11 is wedged angularly into the hole 24 so that the front end A rests against the upper surface of the hole 24 whilst the other end of the section 11 rests against the lower surface of the hole 24. The upper side of the locating part 22 features an essentially horizontal supporting surface 23 against which rests the underside of the fifth section 15, also referred to as the supporting arch. Ideally, the retaining elements of the first section 11 of the clamp 9, the supporting point between supporting surface 23 and supporting arch 15 and the flattened supporting end E are arranged roughly centrally in relation to the length of the locating part 22—when viewed in the longitudinal direction of the rail.

This ensures optimum relations concerning forces and momenti.

In the embodiment shown in FIGS. 8 and 9 the five-section clamp 9 is inserted in a locating part 22 which features on its upper side two rounded ribs 25 that run in the longitudinal direction of the rail. Between them these ribs 25 form a supporting groove 26 whose supporting surface has a bigger radius than the section 15 of the clamp 9 that rests therein. It will be seen that the supporting groove 26 permits even better, especially more accurate support also in the lateral direction, than the first embodiment shown in FIGS. 6 and 7.

The preferred embodiment is illustrated in FIGS. 10 and 11. Here, the locating part 22 features a strip-shaped supporting part 27 with an essentially vertical supporting surface 23. This supporting surface 23 is also aligned towards the hole 24 in an essentially tangential upward direction. It will be seen that the clamp 10 rests against the supporting surface 23 essentially with the whole of the second section 12 which, in this case, forms the supporting arch. The supporting forces run essentially horizontally into the strip-shaped supporting part 27. In addition, it will be seen especially from FIG. 11 that the hole 24 is open towards the top over its full width, essentially over the first third from the insertion side. In this way the supporting surface 23 is extended into the inside of the retaining hole 24. The supporting part 27 has a length of maximum half the length of the locating part 22, whilst its height does not exceed the height of the clamp in inserted condition. Furthermore, the supporting part 27 is chamfered towards the insertion side over at least half its longitudinal extension, so that the driving-in of the clamp 9 is made much easier with this leading-in chamfer.

It will be seen from FIG. 11 that the clamp 10 shows a different supporting behavior in relation to the clamp 9. For example, the inclination of the first section 11 in relation to the horizontal in the hole 24 is exactly the reverse of the situation with the clamp 9, because support occurs in the area of the insertion side on the upper side of the hole 24. Furthermore, the notch 16 encompasses the outlet end of the hole 24, thereby preventing any axial withdrawal of the section 11 of the clamp 10 from the hole 24. The end E of the last section 14 protrudes beyond the front face of the insertion side of the locating part 22. FIG. 11 shows furthermore that the supporting point S of the second section 12 lies against the supporting surface 23 roughly centrally between the lower supporting point at the end A and the supporting point at the end E of the clamp 10. An optimum load condition has consequently been achieved here as well.

FIGS. 12 to 14 show the fastening arrangement in its essentially assembled state. A rail 4 rests with its rail flange 5 on a concrete sleeper 3. On both sides of the rail flange 5 are arranged anchoring parts 20 whose lower parts 21 are cast firmly into the sleeper 3 whilst their locating parts 22 lie above the upper surface of the sleeper. A clamp 10 is driven into the hole of the locating part in the manner described above. FIG. 13 in particular shows how the clamp 10 is supported advantageously by the supporting part 27 of the locating part 22 of the anchoring part 20.

FIGS. 15, 16 and 17 show a bed plate 31. The plate 31 features holes 29 for affixing it to wooden, concrete or metal sleepers. The two locating parts 22 are staggered in such a manner that the sections of the clamps 10 on the side of the rail flange rest essentially on both sides of the rail flange; in relation to the centre line of the plate 31, which runs across the rail, in the proximity of the said centre line on the rail flange.

The anchoring part or bed plate can be a plastic moulding, a casting or a forged part, depending on the load conditions and the relevant application.

Finally, FIGS. 18 to 21 relate to a specially preferred anchoring element which consists in principle of an upper locating part 102 and an anchoring part 103 that extends vertically underneath.

Viewed in the longitudinal direction of the rail, the locating part 2 features a locating hole 104 into which is inserted the first section of a four-section rail clamp 105. On the upper side of the locating part there is arranged a strip-shaped supporting part 106 that points vertically upwards and which features a supporting surface that is orientated essentially vertically and tangentially to the locating hole 104. The supporting part 106 takes up about half the length of the locating part 102, is not higher than the second section of the rail clamp 105 and features a leading-in chamfer 108 over about two thirds or at least half its side facing the insertion side. As will be seen especially from FIGS. 1 and 2, the locating hole is open towards the top in a channel-like manner over about one third of its length, so that the second section of the clamp 105, the so-called supporting arch, can be inserted fully into this area of the locating part.

FIG. 21 shows the distribution of forces when the clamp 105 is driven in, whilst FIG. 18 illustrates the manner of support for the first clamp section in the locating hole 104. Compared to the known fastening arrangements, the anchoring element according to the invention offers a better relationship of forces so that all the elements are subject to less strain and loading. Especially the vertical arrangement of the second section of the clamp, which is loaded in the longitudinal direction of the rail when driving-in the clamp, prevents any twisting of the arrangement about the vertical axis as happens when driving-in the clamps of the known rail anchoring systems.

On the underside of the locating part 102 there are arranged two vertically down-pointing walls 109 that start from the narrow sides of the anchoring part 103 and are orientated across the longitudinal direction of the rail. The walls 109 are preferably of a triangular shape. At the bottom end of the anchoring part 103 there is a triangular foot piece 110 the broad sides of which run parallel to the longitudinal direction of the rail. The foot piece 110 fashioned in this way has a relatively large area and measures at its base about the same length as the locating part. The two sides are designed to end at an acute angle in the narrow sides of the anchoring part 103.

To improve the anchoring effect even further, the anchoring part 103 can be given additional openings or, as it shown in the drawing, a wavy surface.

Finally, FIGS. 22 and 23 show a further embodiment of an anchoring element according to the invention. Here, the locating part 202 is designed as described before, whilst the anchoring part 203 is modified. Its cross-section relative to the longitudinal axis 200 shows the form of a cross as is illustrated in FIG. 23. The plateshaped elements 204 that are arranged in the form of a cross, each feature at their bottom ends a widening 210 that is roughly rectangular in shape and whose upper limit 211 is roughly vertical to the longitudinal axis 200. This design variant proved particularly successful in concrete sleepers since it remains firmly anchored in the concrete sleeper without cracking of the concrete even when subjected to high withdrawal forces.

We claim:

1. Clamp (9, 10) for rails, from a bar of resilient steel with multiple bends, featuring—when viewed in assembled condition— an essentially straight first section (11) that is essentially horizontal, several subsequent curved sections (12, 13) and a last section (14) that lies on a side of the first section that faces the rail, characterized in that a second section (12) is curved upwards in a vertical plane passing through the first section (11), and all subsequent sections of the clamps (9, 10) lie on the side of the first section (11) that faces the rail (4), and wherein clamp (10) consists of four sections (11, 12, 13 and 14) and, in top view, looks like a "$\eta$" and in side view like an "e"-shaped loop, and wherein two ends of the clamp (A, E) protrude beyond the arched sections (12, 13) in the horizontal direction.

2. Clamp according to claim 1, characterized in that the second section forms an arch that covers an angle of at least 180° and whose end points essentially into the same horizontal direction as the end (A) of the first section (11).

3. Clamp in accordance with claim 1, characterized in that the third or last-but-one section (13) is an arch that lies in a plane that is inclined downwards in relation to the horizontal and vertical planes and which covers an angle of at least 180°.

4. Clamp in accordance with claim 1, characterized in that the fourth and last section (14) is essentially straight, preferably describing only a very wide curve that is open towards the top and forming an acute angle in relation to the horizontal and vertical planes passing through the first section (11).

5. Clamp in accordance with claim 1, characterized in that the last section (14) features a flat portion (17) that is relatively short and which is crowned in the vertical plane perpendicular and parallel to the longitudinal direction of the rail.

6. Clamp in accordance with claim 1, characterized in that the clamp (9) consists of five sections with the fifth section (15) lying between the second and third sections (12 and 13 resp.) and essentially running in the same vertical plane as the first and second sections (11 and 12 resp.), and with the fifth section forming an arch whose first part is designed to slope towards the first section and whose second part rises.

7. Clamp in accordance with claim 1, characterized in that the ends (A and E) of the clamp (9) lie within the arched sections (12 and 13).

8. Fastening arrangement of claim 1, characterized in that an anchoring element in accordance with claim 7 is used.

9. Anchoring element for rail fastening arrangements with resilient rail clamps, especially for rails resting on concrete sleepers, with—when viewed in assembled condition— an upper locating part (102) that features a locating hole (104) and, in the longitudinal direction of the rail, a supporting surface for a rail clamp (105), and a vertically down-pointing anchoring part (103) that has, in the horizontal section, essentially the form of a narrow rectangle and which features triangular projections at its bottom end and walls connected to the retaining part at its upper end, characterized in that the supporting surface (107) of the locating part (102) is arranged essentially vertically above the locating hole (104), that the triangular projection at the bottom end of the anchoring part (103) forms an essentially equal-sided, triangular foot piece (110) whose cross-section has essentially the form of a narrow rectangle that is orientated analogously to that of the remaining anchoring part, and whose base forms the lower surface of the anchoring part, while its two sides end with an acute angle in the narrow sides of the anchoring part (103), so that the wide sides of the foot piece (110) are aligned parallel to the longitudinal direction of the rail, and that the walls (109) are arranged across the longitudinal direction of the rail and starting from the narrow sides of the anchoring part (103), and wherein said supporting surface (107) of the locating part (102) lies in a vertical plane that runs tangentially to the side of the locating hole (104) that points away from the rail, and that this supporting surface (107) is arranged at a supporting part (106) protruding strip-like from the surface of the locating part (102).

10. Anchoring element in accordance with claim 9, characterized in that the walls (109) are designed as equal-sided triangles with the apexes pointing downwards.

11. Anchoring element in accordance with claim 9, characterized in that the anchoring part (103) features additional openings and/or wavy surfaces.

12. Anchoring element of claim 9 with an upper locating part for a clamp and an anchoring part for fastening to a sleeper, characterized in that, across its longitudinal axis (200), the anchoring part (203) has the shape of a cross the elements of which are each showing a roughly rectangular widening (210) at the lower end whose upper limit (211) is roughly vertical to the longitudinal axis of the anchoring part.

* * * * *